US005290486A

United States Patent [19]

Enarson

[11] Patent Number: 5,290,486

[45] Date of Patent: Mar. 1, 1994

[54] DESUPERHEATER FOR CONTROLLABLE INJECTION OF COOLING WATER IN A STEAM OR GAS LINE

[75] Inventor: Knut Enarson, Säffle, Sweden

[73] Assignee: BTG Kalle Inventing AG, Säffle, Sweden

[21] Appl. No.: 940,954

[22] Filed: Oct. 29, 1992

[30] Foreign Application Priority Data

May 8, 1990 [SE] Sweden ..... 9001643-7

[51] Int. Cl.[5] ..... B01F 3/04

[52] U.S. Cl. ..... 261/66; 261/DIG. 13; 261/116; 239/471

[58] Field of Search ..... 261/116, DIG. 13, 66; 239/460, 468, 471

[56] References Cited

U.S. PATENT DOCUMENTS

| | | | |
|---|---|---|---|
| 2,247,897 | 7/1941 | Wahlin | 239/468 |
| 2,354,842 | 8/1944 | Spence | 261/DIG. 13 |
| 2,815,248 | 12/1957 | O'Brien | 239/468 |
| 3,331,590 | 7/1967 | Battenfeld et al. | 261/DIG. 13 |
| 3,373,942 | 3/1968 | Roman et al. | 239/460 |
| 3,931,371 | 1/1976 | Maurer et al. | 261/116 |
| 4,909,445 | 3/1990 | Schoonover | 261/DIG. 13 |

FOREIGN PATENT DOCUMENTS 8303365 10/1983 World Int. Prop. O. .

*Primary Examiner*—Tim Miles

*Attorney, Agent, or Firm*—Ostrolenk, Faber, Gerb & Soffen

[57] ABSTRACT

The invention relates to improvements in or relating to a desuperheater for controllable injection of cooling water in a steam or gas line (17), said desuperheater device including an insertion tube (1) extending inside the pipe (17), said tube (1) having a conical outlet nozzle (7) with a valve body (5) movably arranged in a hole (2) in the insertion tube (1) such as to form a regulating port (4). The hole (2) in the insertion tube (1) opens out into a rotation chamber (3) with the centerline (10) of the hole and the centerline (11) of the rotation chamber (3) disposed relative each other at an angle deviating from 90° by an angle $\alpha$, and where the angle $\alpha$ is greater than 0° but less than 30°.

8 Claims, 2 Drawing Sheets

DESUPERHEATER FOR CONTROLLABLE INJECTION OF COOLING WATER IN A STEAM OR GAS LINE

BACKGROUND OF THE INVENTION

1. Field of the Invention

The present invention relates to improvements in or relating to a desuperheater for controllable injection of cooling water in a steam or gas line, where the desuperheater heater includes an insertion tube extending into the line and having a conical outlet nozzle, in the nozzle there being a valve body movably disposed in an aperture such as to form a regulating port.

1. Description of the Related Art

Such superheater devices, particularly for steam, are customarily used for cooling and/or regulating steam temperatures. These devices often comprise an injection nozzle provided with a single-seat means regulating the degree of opening, for increasing the cooling water speed at the nozzle outlet. The injected cooling water will thus be forced out in a thin, conically shaped jet consisting of extremely small water droplets, which evaporate almost immediately. There are many fields of use, but the majority of installations where these devices are used can usually be put into one of the following classes of general and industrial standard installations: power stations which, apart from the high pressure and the high temperature side, also produce steam for auxiliary machines, heating systems and tap stations; with surface heat exchangers for better heat transfer; on boilers, either between the super heating steps or for regulating the partial load steam temperature; cooling of superheated steam for adjusting the steam temperature to an industrial process; anywhere where the process or scrubbing steam is required in the low pressure system in process industries and refineries; or a district heating plant.

An interesting application, not included in the use in connection with steam, is cooling a gas by injecting it in its liquid phase.

A known type of desuperheater device of the kind in question is illustrated in the Swedish Patent Specification SE 6613074, relating to a steam desuperheater which includes an insertion tube which can be mounted at 60°–45° to the pipeline in which the cooled medium flows. This tube includes in turn a cylindrical valve body for regulating the cooling water by uncovering tangentially bored holes in a tube inside the insertion tube. Such a solution signifies that the cooling water forms a cone at the end of the insertion tube inside the line in question. With the method of installation demanded by older types of desuperheaters, and which is also required for the previously known application just mentioned, there is under certain conditions an obvious risk that unvaporized water droplets can reach the opposing pipe wall and cause damage in the form of erosion.

SUMMARY OF THE INVENTION

One object of the present invention is to achieve improvements in a device of the kind mentioned in the introduction, where the disadvantages to be found in the structures described above have been eliminated.

Due to the invention there now have been provided improvements in a desuperheater device resulting in a very large range of regulation of the cooling water injected into a line containing steam or gas which is to be cooled. Another advantage of the invention is that there is achieved injection of the cooling water in a very finely divided form, even for small flows, and with distribution over the entire pipe cross section, as well as the device being mountable at right angles to the line. This arrangement provides low fitting and installation costs.

BRIEF DESCRIPTION OF THE DRAWINGS

The invention will now be described in more detail with reference to the accompanying drawings, where.

DESCRIPTION OF THE PREFERRED EMBODIMENT

Figure 1:
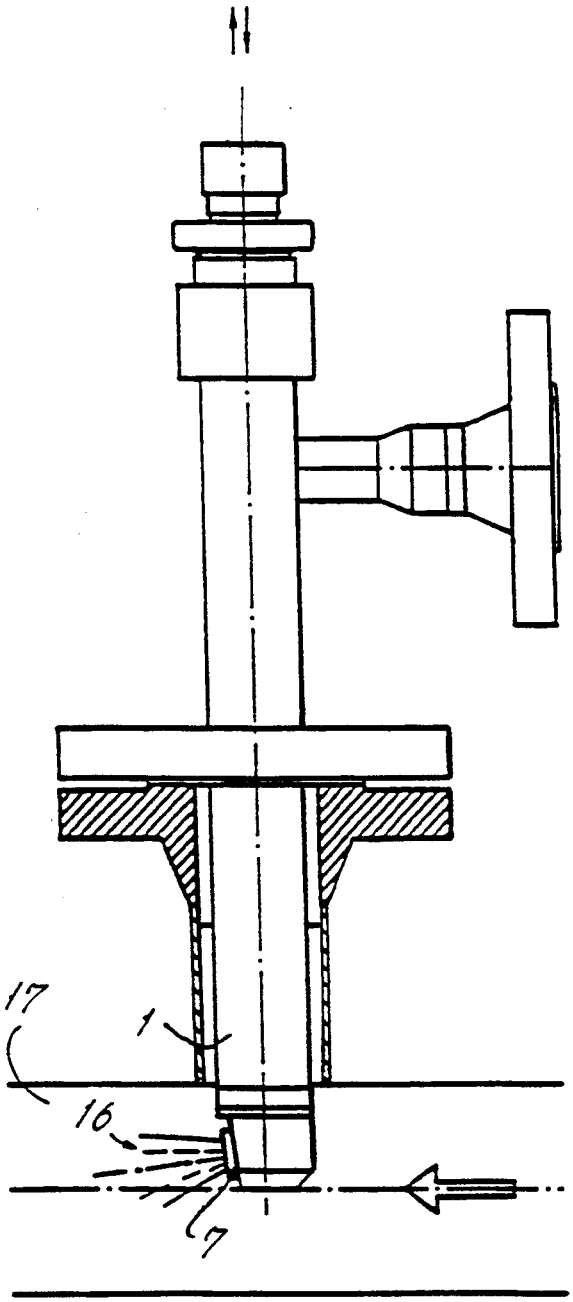
FIG. 1 is a schematic, partially cross-sectional side view of a device according to a preferred embodiment of the present invention.
Figure 2:
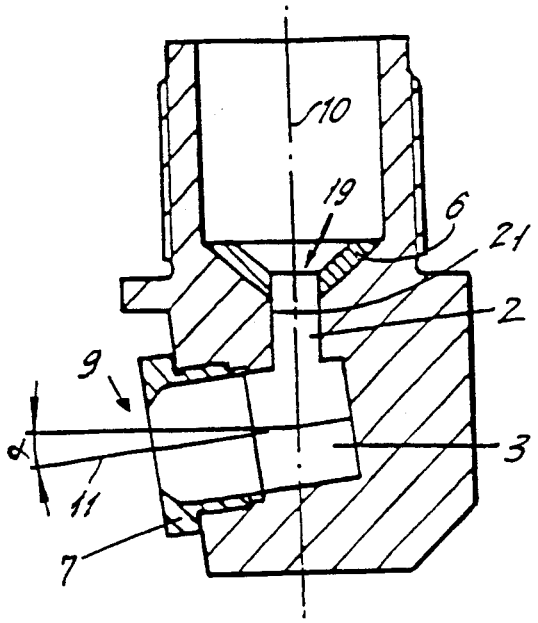
FIG. 2 is a partial cross section through the forward part of the insertion tube illustrated in FIG. 1, without valve bodies.
Figure 3:
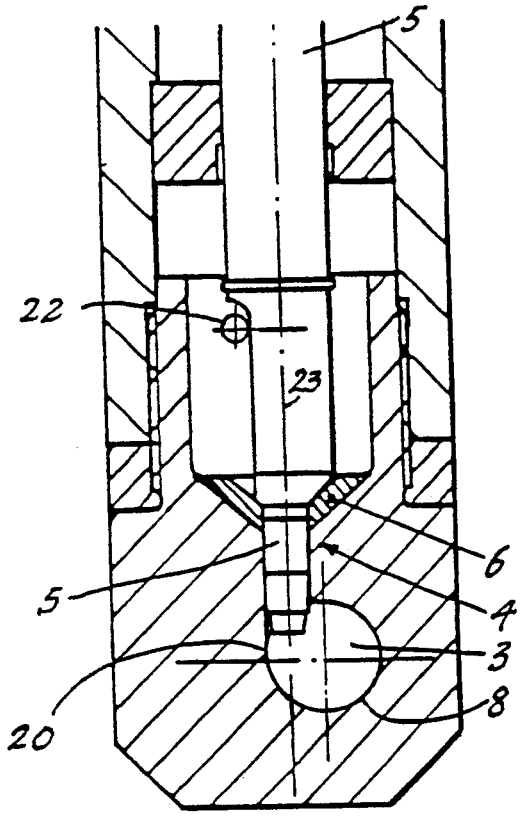
FIG. 3 illustrates a partial cross-section from one side of the insertion tube illustrated in FIG. 2.
Figure 5:
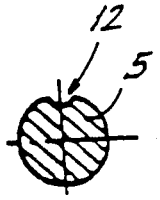
FIG. 5 is a cross-section of the forward end of the valve body illustrated in FIG. 4.
Figure 4:
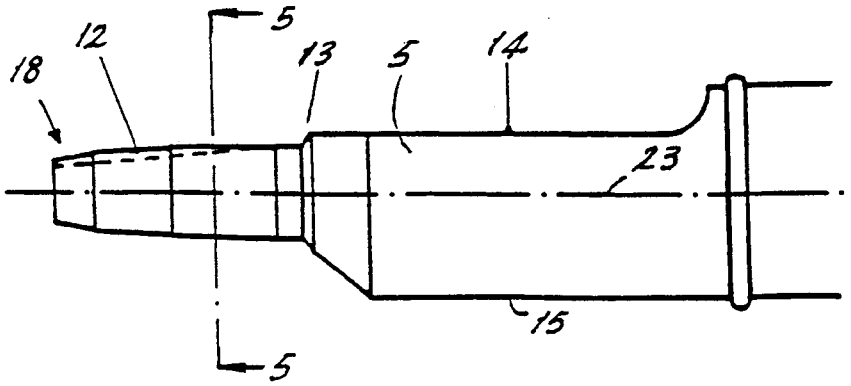
FIG. 4 is an enlarged side view of a valve body situated inside the insertion tube illustrated in FIG. 3.

As will be seen from FIG. 1, the desuperheater device in accordance with the present invention comprises an insertion tube 1 extending into a pipeline 17, and having a conical outlet nozzle 7. In accordance with FIG. 1, the device is mounted at a right angle to the pipeline 17, with the outlet nozzle 7 in, or close to the center of the pipeline 17. As is also apparent from FIGS. 2 and 3, the insertion tube 1 includes a valve body 5 arranged displaceably therein. The lower portion of the valve body 5, i.e. its tip 18, extends through a hole 2 forming a regulating port 4, and having a seat 6, and to a rotation chamber 3. As will be seen in more detail from FIG. 2, the centerline 10 of the hole 2 and the centerline 11 of the rotation chamber 3 form an angle deviating from 90° by an angle $\alpha$, and where the angle $\alpha$ is greater than zero and less than 30°, and preferably being between 1°–15°. The angle $\alpha$ provides good function, particularly for small flows (high regulation) of the cooling water injected into the pipeline 17. The valve body 5 includes, as will be seen more clearly from FIG. 4, a sealing surface 13 for sealing co-action with the seat 6 formed in the inlet opening 19 of the hole 2. In addition, the valve body 5 has a groove 12 extending from the sealing surface 13 to the tip 18 of the valve body 5, this groove being situated in the curved surface 15 of the valve body 5 below the sealing surface 13, and is formed such that its cross sectional area may increase successively. The groove 12 may be parallel to the curved surface 21 of the hole 2 or with the center line 23 of the valve body 5, in order to provide maximum rotational speed, particularly for small flows, or in special cases, the groove 12 can also slope successively in a direction towards the tip 18 of the valve body 5 for achieving desired flow characteristics. As will be seen from FIG. 3, the groove 12 made in the valve body 5 is turned to a position in the hole 2 in which the groove 12 coincides in the rotation chamber 3 with the tangent 20 for the curved surface 8 of the chamber 3. This position is maintained by a rotation stop 22 co-acting with a flat machined surface 14 on the curved surface 15 of the valve body 5 above the sealing surface 13. In addition, the sealing surface 13 is conically shaped where the groove 12 begins and is minimized in a radial direction by the machined surface 14 on the curved surface 15 of the valve body 5 above the sealing surface 13. The curved surface 15 of the valve body 5, below the sealing surface 13, in the direction towards the valve body tip 18, may have a conical or parabolic shape along certain sections of its length.

With this implemation, the rotation chamber 3 will not be completely filled with liquid for small flows and only a rotating film of water is formed, this film having a helical movement in a direction towards the outlet nozzle 7 along the curved surface 8 of the rotation chamber 3. The water film can maintain its rotation on the way towards the outlet 9 of the insertion tube 1 and through the outlet nozzle 7, without being braked by any water in the middle of the rotation chamber 3. When the water film is forced into the diametrically decreased outlet nozzle 7 the rotation increases with the diameter relationship.

In order to further enable a large regulation range for the device, the valve body 5 is provided with the groove 12 which is twisted towards the curved surface 8 of the rotation chamber 3 and along this surface the water can flow when the flow is small. Since the sealing surface 13 of the valve body 5 is conically shaped, and due to the flat machining 14 on the body 5 above the sealing surface 13, there has been provided a small sealing surface for minimizing friction losses as much as possible. The pressure difference is thus converted instead into the greatest possible speed. In other words, the implementation in accordance with the invention allows sealed closure without interfering with regulatability. No piston rings or other gliding sealings are required, which ensures low friction, small hysteresis and smooth operation with no "pulling". Other advantages provided by the implementation are, inter alia, that for one insertion tube there can be 5–7 different valve body and nozzle sizes, which provides standardizing advantages and efficient manufacture, and together with less material consumption results in lower manufacturing costs. In addition, the perpendicular fitting of the device provides lower fitting and installation costs than those applicable to conventional desuperheaters.

The water droplets sprayed out from the nozzle 7 form an outlet cone 16 see FIG. 1, and due to the angle $\alpha$ this cone is directed with downward inclination inside the pipe 17. In the illustrated embodiment the outlet nozzle 7 is arranged in or close to the center of the pipe, water droplets that may not have been vaporized thus being provided with a maximum distance to move before the pipe wall itself is reached, thus providing less risk of erosion damage. In the cases where pipelines with a larger diameter are used, the outlet nozzle 7 can be extended close to the inner wall of the pipe 17 and the angle $\alpha$ selected so that the risk of erosion damage is eliminated, and since a short insertion tube can be used in this case, the mechanical stresses on it will be small, while at the same time the perpendicular mounting and the unified lengths of the steam desuperheaters will be maintained.

I claim:

1. A desuperheater device for the controllable injection of cooling water into a steam or gas line, comprising:

an insertion tube extending into the line;

a conical outlet nozzle having a valve body movably mounted within the hole in the insertion tube so as to form a regulating port; and a groove extending along the valve body, wherein the groove is positioned in the hole such that the groove opens along the tangent of a curved surface of the rotation chamber, and wherein the rotation chamber has a centerline which is disposed relative to the centerline of the hole to form an angle which deviates from 90° by an angle $\alpha$, angle $\alpha$ being within the range of 0° to 30°.

2. The device of claim 1, wherein the angle $\alpha$ is between 1° to 15°.

3. The device of claim 1, wherein the valve body includes a curved surface and a flat machined surface, the position of the groove in the hole being maintained by a rotation stop which abuts against the flat machines surface of the valve body.

4. The device of claim 3, wherein the valve body has a sealing surface which forms a seal with a seat formed on the inlet opening of the hole.

5. The device of claim 4, wherein the sealing surface is conical and is minimized in a radial direction by the flat machined surface of the valve body.

6. The device of claim 4, wherein the curved surface of the valve body, below the sealing surface and in a direction extending toward the tip of the valve body, is conically formed.

7. The device of claim 4, wherein the curved surface of the valve body, below the sealing surface and in a direction extending toward the tip of the valve body, has a parabolic cross-section.

8. A desuperheater device for the controllable injection of cooling water into a steam or gas line, comprising:

an insertion tube extending into the line, the insertion tube including a hole having a centerline and an inlet opening, wherein the hole opens into a rotation chamber;

a conical outlet nozzle having a valve body movably mounted within the hole to form a regulating port, the valve body including a flat machined surface and a curved surface;

a sealing surface on the valve body which forms a seal with a seat on the inlet opening of the hole;

a groove extending along the curved surface of the valve body from below the sealing surface to a tip of the valve body, wherein the groove is positioned in the hole such that the groove opens out along the tangent of a curved surface of the rotation chamber, and wherein the rotation chamber has a centerline which is disposed relative to the centerline of the hole to form an angle which deviates from 90° by an angle $\alpha$, angle $\alpha$ being within the range of 0° to 30°; and a rotation stop which abuts against the flat machined surface of the valve body to maintain the position of the groove in the hole.

* * * * *